United States Patent [19]

Riegel et al.

[11] 4,303,007

[45] Dec. 1, 1981

[54] CEILING AIR OUTLET FOR AIR CONDITIONING SYSTEM

[75] Inventors: Hans Riegel, Geldern; Gerd Kurzhals, Duisburg, both of Fed. Rep. of Germany

[73] Assignee: Gebrueder Trox GmbH, Neukirchen-Vluyn, Fed. Rep. of Germany

[21] Appl. No.: 55,354

[22] Filed: Jul. 6, 1979

[30] Foreign Application Priority Data

Jul. 6, 1978 [DE] Fed. Rep. of Germany ... 7820323[U]

[51] Int. Cl.[3] ..... F24F 13/08

[52] U.S. Cl. ..... 98/40 D; 98/40 B; 98/40 VM; 98/41 R

[58] Field of Search ..... 98/40 R, 40 B, 40 C, 98/40 D, 40 DL, 40 VM, 40 V, 41 R, 38 C; 137/625.18, 595

[56] References Cited

U.S. PATENT DOCUMENTS 2,737,875 3/1956 Kurth et al. ..... 98/40 B 3,118,604 1/1964 Bertin et al. ..... 98/40 V 3,363,534 1/1968 Spradling ..... 98/38 C

FOREIGN PATENT DOCUMENTS 2033194 1/1972 Fed. Rep. of Germany ..... 98/40 D

*Primary Examiner*—Albert J. Makay
*Assistant Examiner*—Harold Joyce
*Attorney, Agent, or Firm*—Shlesinger, Arkwright, Garvey and Dinsmore

[57] ABSTRACT

An air conditioning system ceiling air outlet comprising a warm air duct for vertically downward direction of warm air, a cold air duct surrounding the warm air duct for outwardly directing cold air, the ducts terminating at their inlet ends in a common connecting stub, covering plates for the intake ends of each of the ducts and mounted in the connecting stub, the covering plates being mounted on a common axis of rotation and at an angle to each other so that when one of said ducts is closed by one of said plates, the other of said ducts is open.

6 Claims, 1 Drawing Figure

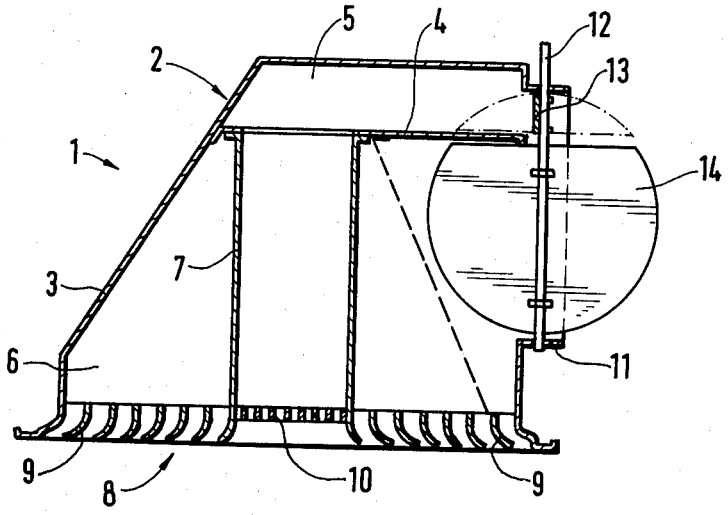
5
4
12
2
13
1
14
7
3
6
11
9
8
10
9

CEILING AIR OUTLET FOR AIR CONDITIONING SYSTEM

The invention relates to an air conditioning system ceiling air outlet in which some of the flow discharge surfaces, more particularly in the edge region, are provided with outwardly oriented blades for guiding the air emerging therefrom along the ceiling.

Stringent requirements are made on the air guidance of ceiling air outlets in air conditioning systems, i.e. systems which supply cold air in summer as well as warm air in winter. In cold air operation it is desirable for a large part of the air to be guided along the ceiling in order to avoid draughts and—by the gradual descent of the cold, heavy air in the downward direction—to achieve a uniform temperature distribution.

This air distribution is achieved by virtue of a broad edge region of the ceiling air outlet having outwardly oriented blades which therefore deflect the airstream in this direction while a small middle region is provided with guide plates which are perpendicular or can be set into the perpendicular.

Horizontal air distribution however is unsuitable for warm air operation because a warm air cushion would then form beneath the ceiling and would therefore not descend while the bottom regions of the room remain cold owing to the lack of warm air supply. Air distribution and therefore temperature stratification in warm air operation can be improved by the adjustable construction or the retraction of the blades into a preceding connecting box because the entire amount of warm air will then be discharged while being downwardly directed. To obtain the most uniform possible temperature distribution it is however also necessary for the warm air stream to extend sufficiently far downwardly, i.e. to have the greatest possible penetration depth. This in turn calls for a correspondingly high exit velocity of the warm air. Owing to the large cross-sectional surface area of the ceiling air outlet required for cold air operation, this exit velocity results in a substantially higher volumetric flow than would be necessary for heating the room. Achieving a uniform temperature distribution therefore requires substantially more heating energy than is necessary. Moreover, the adjusting mechanism of such ceiling air outlets is very complicated and trouble-prone.

It is therefore the object of the invention to construct a ceiling air outlet of the kind described hereinbefore so that optimum temperature distribution with a substantially lower energy consumption is achieved both in cold air and in warm air operation.

According to the invention the problem is solved in that the ceiling air outlet is provided with adjustable covering means, at least for those parts of the flow exit surface which is provided with outwardly oriented blades. In warm air operation, this part of the flow exit surface can therefore be closed with the adjustable covering means against the discharge of air so that the effective exit flow cross-section is correspondingly restricted and no further deflection to the side takes place. A substantially lover volumetric flow of warm air is therefore sufficient to achieve the same exit flow velocity and therefore the same penetration depth, thus leading to a corresponding reduction of heating energy requirements. An embodiment of the invention provides that the part of the flow discharge surface which is provided with outwardly oriented blades occupies one half to 9/10 of the entire flow discharge surface. An optimum energy saving can be achieved in this region, combined with an adequate penetration depth.

A further embodiment of the invention proposes that the ceiling air outlet is provided with a connecting casing divided into an outer and an inner discharge duct and the outer discharge duct merges into the part of the flow discharge surface which is provided with outwardly oriented blades and is provided with a covering device and the inner flow discharge duct is downwardly oriented into the remaining flow discharge surface. This results in a particularly simple ceiling air outlet. For symmetrically constructed ceiling air outlets it is convenient for the inner flow discharge duct to be surrounded by the outer, more particularly by being disposed centrally with respect to the outer flow discharge duct.

According to another feature of the invention the connecting casing is provided with a lateral connecting socket the top part of which extends into a top chamber of the connecting casing from which a perpendicularly extending, straight pipe extends as inner flow discharge duct to the flow discharge surface and the bottom part extends into the remaining part of the connecting casing.

The invention also provides that the inner flow discharge duct is provided with a covering device. In this way it is possible for the inner flow discharge duct to be closed when it is in cold air operation so that cold air flows only tangentially with respect to the ceiling and does not generate any draughts.

Another feature of the invention proposes that the covering device or devices is or are disposed in the region of the connecting socket of the connecting casing. A convenient solution to this problem is obtained if the covering device or devices is or are constructed as a covering flap or flaps.

The invention also provides that the covering flap or flaps is or are provided with a centrally extending pivoting axis. If two covering plates are provided they should be disposed on a common pivoting axis side by side and at an angle with respect to each other. Conveniently, the angle should be 90°. In this way one or the other flow discharge ducts will alternately be open or closed.

Finally, the invention provides that the part of the flow discharge surface without outwardly oriented blades is provided with a flow equalizing grid having perpendicular grid bars.

One exemplified embodiment of the invention is illustrated in the accompanying drawing. This shows in a vertical section a ceiling air outlet 1 of rectangular horizontal cross-section with a connecting casing 2 having sloping side walls 3. The interior of the connecting casing 2 is divided into a top chamber 5 and into a bottom chamber 6 by means of a horizontal bulkhead 4 disposed in the top region.

A pipe 7, extending perpendicularly in the downward direction through the middle of the bottom chamber 6 as far as the furthest charge surface 8 extends from the top chamber 5. Outwardly bent blades 9 are disposed in the said flow discharge surface 8 between the pipe 7 and the lateral surfaces 3 of the connecting casing 2 and a flow equalizing grid 10 is provided in the opening of the tube 7.

A connecting socket 11 of circular cross-section is integrally formed on the side of the connecting casing 2 which is on the left of the view and is disposed sufficiently high so that the air is able to flow into the top chamber 5 as well as into the bottom chamber 6. The entry cross-section into the top chamber 5, forming a circular segment, is substantially smaller than the entry cross-section which extends into the bottom chamber 6 and also forms a circular segment. In the middle of the connecting socket 11 directly in front of the edge associated with the bulkhead 4 and shown on the right-hand side of the drawing, there is provided a perpendicularly extending pivoting shaft 12 on which two cover plates 13, 14 of circular segmental form are disposed one above the other and at right angles to each other. The surfaces of both covering plates 13, 14 correspond to the entry cross-sections of the top chamber 5 and of the bottom chamber 6.

In the illustrated position the top chamber 5 is closed by the top covering plate 13 (this is positioned perpendicularly with respect to the plane of the drawing), i.e. it fully covers the entry cross-section of the said chamber. The bottom covering plate 14 (this is positioned parallel with the plane of the drawing) exposes the entire entry cross-section for the bottom chamber 6. The air which flows inwardly via the connecting socket 11 therefore passes exclusively into the bottom chamber 6 and flows via the flow discharge surface 8 between the outer edge of the pipe 7 and the side walls 3 towards the outside and is deflected by the blades 9 tangentially towards the ceiling.

This position of the deflecting flaps 13, 14 is intended for cold air operation because the cold air will then initially remain in the region of the ceiling and slowly descend downwardly so that after some time a uniform temperature distribution without draughts is obtained. For hot air operation the pivoting shaft 12 is rotated through 90° so that the covering plate 13, 14 assume the position shown in broken lines. The inlet cross-section for the top chamber 5 is then exposed while that of the bottom chamber 6 is closed. Warm air will then flow exclusively into the top chamber 5 and from there pass into the pipe 7 from whose opening in the flow discharge surface it flows perpendicularly downwardly after being equalized by the flow equalizing grid 10.

The flow discharge cross-section of the pipe 7 is smaller than half the entire flow discharge surface 8 but despite a comparatively smaller warm air flow volume, which is nevertheless sufficient for space heating, has a high exit velocity and therefore a large penetration depth. A uniform temperature distribution is therefore achieved with a substantially smaller volumetric flow and a correspondingly lower expenditure of energy.

What is claimed is:

1. An air conditioning system ceiling air outlet having a discharge surface comprising:

a vertically downwardly directed warm air discharge duct for vertically downward direction of warm air at said discharge surface, a vertically downwardly directed cold air discharge duct surrounding said warm air duct and having outwardly directed blades at the discharge end thereof for substantially horizontal direction of cold air at said discharge surface, said ducts terminating at their intack ends in a common connecting horizontal stub having a horizontal bulkhead therein forming said stub into a top portion and a bottom portion, said top portion being in fluid communication with said warm air duct and said bottom portion being in fluid communication with said cold air duct, covering plates for each of said portions and mounted in said connecting stub, said covering plates being mounted on a common axis of rotation and at an angle to each other so that when one of said portions and the associated duct is closed by one of said plates, the other of said portions and its associated duct is open.

2. A ceiling air outlet as in claim 1 and wherein:

the discharge of said warm air duct is centrally disposed with respect to the discharge of said cold air duct.

3. A ceiling air outlet as in claim 1 and wherein:

said covering plates are mounted on a common pivot shaft diametrically mounted in said connecting stub.

4. A ceiling air outlet as in claim 3 and wherein said angle is about 90°.

5. A ceiling air outlet as in claim 4 and wherein said warm air duct includes a flow equalizing grid at said discharge surface.

6. A ceiling air outlet as in claim 5 and wherein the cold air discharge portion of said surface comprises about 0.5–0.9 of the total area of said surface.

* * * * *